US007104724B2

(12) United States Patent
Terry

(10) Patent No.: US 7,104,724 B2
(45) Date of Patent: Sep. 12, 2006

(54) APPARATUS FOR TREATING A PAVEMENT SURFACE

(75) Inventor: Phillip Rand Terry, Hamilton, OH (US)

(73) Assignee: Highway Preservation System, Ltd., Hamilton, OH (US)

( * ) Notice: Subject to any disclaimer, the term of this patent is extended or adjusted under 35 U.S.C. 154(b) by 939 days.

(21) Appl. No.: 10/213,735

(22) Filed: Aug. 7, 2002

(65) Prior Publication Data

US 2002/0190138 A1 Dec. 19, 2002

Related U.S. Application Data

(63) Continuation-in-part of application No. 09/616,704, filed on Jul. 14, 2000, now Pat. No. 6,444,258.

(51) Int. Cl.
*E01C 19/18* (2006.01)

(52) U.S. Cl. ..... 404/110; 404/101; 404/108; 404/111

(58) Field of Classification Search ..... 404/101, 404/108, 110, 111
See application file for complete search history.

(56) References Cited

U.S. PATENT DOCUMENTS 5,324,136 A * 6/1994 Reymonet et al. ..... 404/107
5,895,173 A * 4/1999 O'Brien et al. ..... 404/108
6,444,258 B1 * 9/2002 Terry ..... 427/138

* cited by examiner

*Primary Examiner*—Gary S. Hartmann
(74) *Attorney, Agent, or Firm*—James P. Davidson, Esq.

(57) ABSTRACT

An apparatus for treating a pavement surface with a plurality of layers in a single pass, including: a chassis having a forward end and a rear end; a plurality of rolling means spaced longitudinally along the chassis for supporting the chassis so it can roll along a particular direction of advance; a powerplant for moving the chassis along the direction of advance; a first storage tank mounted on the chassis for containing bituminous sealant; a second storage tank mounted on the chassis for containing bituminous emulsion; a main hopper mounted on the chassis for storing aggregate particles; a first mechanism in flow communication with the first storage tank for applying a layer of bituminous sealant at a predetermined temperature and application rate on the pavement surface; a second mechanism in flow communication with the second storage tank for applying a layer of bituminous emulsion at a predetermined temperature and application rate on the layer of bituminous sealant, wherein a thermal reaction occurs between the bituminous sealant and the bituminous emulsion so as to accelerate a material break and cure time for the layers; and, a third mechanism in flow communication with the main hopper for providing a layer of aggregate particles at a predetermined application rate on the layers of bituminous sealant and bituminous emulsion during the thermal reaction.

19 Claims, 7 Drawing Sheets

APPARATUS FOR TREATING A PAVEMENT SURFACE

CROSS-REFERENCE TO RELATED APPLICATION

The present application is a continuation-in-part of an application entitled "Method Of Treating A Pavement Surface And Apparatus For Performing Such Method," filed on Jul. 14, 2000 and having Ser. No. 09/616,704 now U.S. Pat. No. 6,444,258.

BACKGROUND OF THE INVENTION

1. Field of the Invention

The present invention relates generally to treating a pavement surface and, more particularly, to an apparatus for treating a pavement surface which functions to repair points of distress in the pavement and provide a durable wearing surface in a single pass.

2. Description of Related Art

Modern roadways are usually paved in order to provide a more durable surface for vehicular traffic. Over time, existing roadways inevitably become worn and in need of repair. For example, cracks may develop so that the surface is no longer water resistant and deterioration of the roadway occurs at an accelerated pace. Alternatively, the surface may become overly smooth so that the skid resistance of the roadway is adversely affected. In either event, the existing roadway surface becomes dangerous to drive on and therefore presents a public safety concern. Accordingly, existing roadways should be periodically resurfaced or repaved in the course of proper maintenance.

As explained in U.S. Pat. No. 5,895,173 to O'Brien et al., one type of resurfacing process (known in the industry as "chipsealing") involves the dropping of aggregate material into a previously applied layer of adhesive material so as to bind the aggregate material to the surface. Typically, the two steps of the chipsealing process are performed by two different machines, an asphalt distributor and a chipspreader, making two separate passes over the same portion of roadway. While improvements have been made to overcome some of the inherent deficiencies of this process, including the ability to perform both steps in a single pass, it is a continuing goal in the industry to accelerate the material break and cure time of the completed product so as to permit traffic to resume use as soon as possible. Further, it is desired that additional improvements in the areas of reflective cracking and waterproofing over the current chipsealing process be achieved.

Accordingly, it is a primary object of the present invention to provide a method of treating a pavement surface which can be utilized as an interlayer prior to asphalt overlays or as a final preventive maintenance surface.

It is another object of the present invention to provide a method of treating a pavement surface that produces a membrane that dissipates crack propagation forces, waterproofs the pavement, and is durable to traffic.

It is still another object of the present invention to provide a method of treating a pavement surface that reduces reflective cracking and provides a textured surface for asphalt paving.

Yet another object of the present invention is to provide a method of treating a pavement surface that produces a complete product in one pass, thereby reducing construction delays and costs.

Another object of the present invention is to provide a method of treating a pavement surface that accelerates the material break and cure time of the completed product, thereby permitting use of the pavement surface more quickly.

Still another object of the present invention is to provide a method of treating a pavement surface that improves adhesion between the completed product and the existing pavement surface.

These objects and other features of the present invention will become more readily apparent upon reference to the following description when taken in conjunction with the following drawings.

SUMMARY OF THE INVENTION

In accordance with a first aspect of the present invention, an apparatus for treating a pavement surface with a plurality of layers in a single pass is disclosed as including: a chassis having a forward end and a rear end; a plurality of rolling means spaced longitudinally along the chassis for supporting the chassis so it can roll along a particular direction of advance; a powerplant for moving the chassis along the direction of advance; a first storage tank mounted on the chassis for containing bituminous sealant; a second storage tank mounted on the chassis for containing bituminous emulsion; a main hopper mounted on the chassis for storing aggregate particles; a first mechanism in flow communication with the first storage tank for applying a layer of bituminous sealant at a predetermined temperature and application rate on the pavement surface; a second mechanism in flow communication with the second storage tank for applying a layer of bituminous emulsion at a predetermined temperature and application rate on the layer of bituminous sealant, wherein a thermal reaction occurs between the bituminous sealant and the bituminous emulsion so as to accelerate a material break and cure time for the layers; and, a third mechanism in flow communication with the main hopper for providing a layer of aggregate particles at a predetermined application rate on the layers of bituminous sealant and bituminous emulsion during the thermal reaction.

In accordance with a second aspect of the present invention, an apparatus for providing a surface treatment to pavement is disclosed as including: a chassis having a forward end and a rear end; a plurality of rolling means spaced longitudinally along the chassis for supporting the chassis so it can roll along a particular direction of advance; a powerplant for moving the chassis along the direction of advance; a first storage tank mounted on the chassis for containing bituminous sealant; a second storage tank mounted on the chassis for containing bituminous emulsion; a main hopper mounted on the chassis for storing aggregate particles; a spreader box connected to the chassis and in flow communication with the first storage tank, wherein a layer of bituminous sealant is applied at a predetermined temperature and application rate on the pavement; a spray bar connected to the chassis rearwardly of the spreader box and in flow communication with the second storage tank, wherein a layer of bituminous emulsion is applied at a predetermined temperature and application rate on the layer of bituminous sealant; and, a distribution device in flow communication with the main hopper, wherein a layer of aggregate particles is provided at a predetermined application rate on the layers of bituminous sealant and bituminous emulsion.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
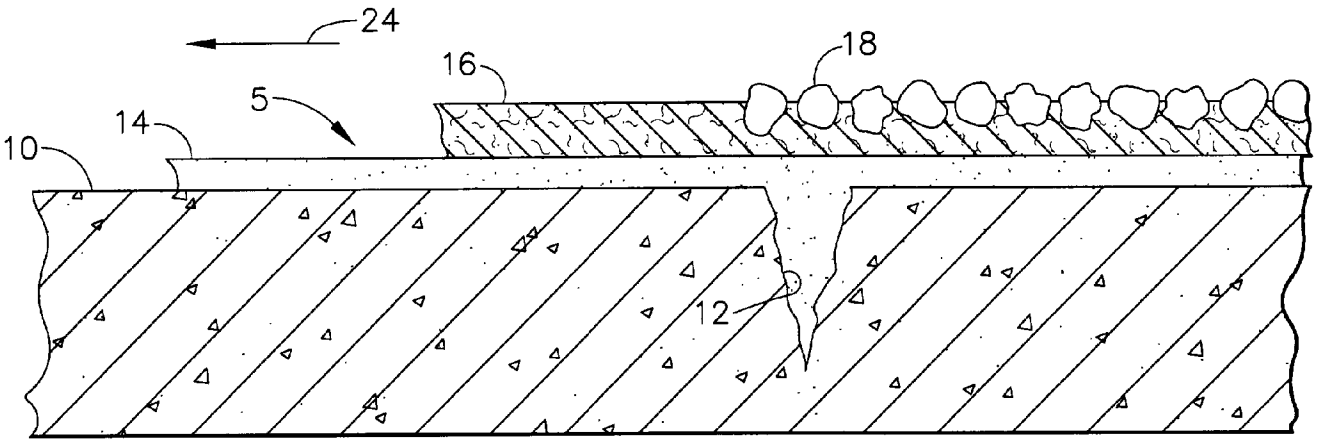
FIG. 1 is an enlarged cross-sectional view of a surface treatment applied to an existing pavement surface as a final preventive maintenance surface in accordance with the method of the present invention.
Figure 2:
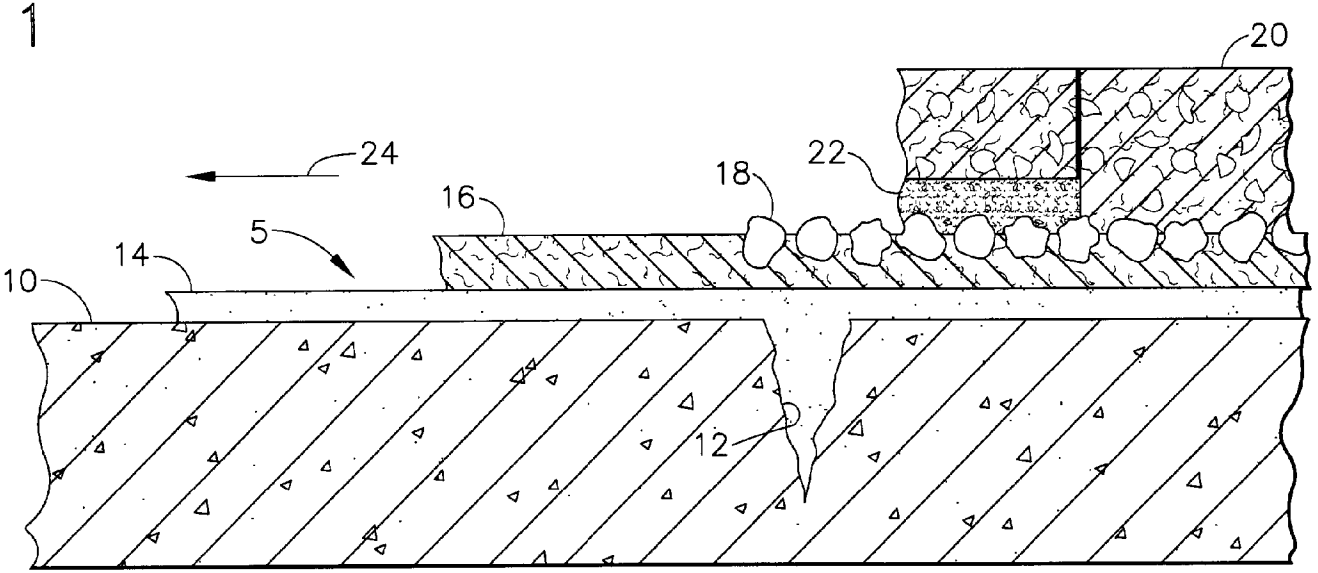
FIG. 2 is an enlarged cross-sectional view of a surface treatment applied to an existing pavement surface as an interlayer between the existing pavement surface and an asphalt layer in accordance with the method of the present invention.

Referring now to the drawings in detail, wherein identical numerals indicate the same elements throughout the figures, FIG. 1 depicts a cross-sectional view of the pavement surface treatment of the present invention, identified generally by reference numeral 5. More specifically, existing pavement 10 is depicted as having an exemplary crack or void 12 therein. Surface treatment 5 includes a layer 14 of bituminous sealant applied to pavement 10 so as to substantially fill all points of distress therein (i.e., cracks, joints, voids, ravels and porous surfaces). This is evidenced by the filling of crack 12 in FIG. 1. Rather than merely fill such points of distress on an individual basis, it will be appreciated that bituminous sealant layer 14 constitutes a substantially continuous surface on pavement 10 and is sometimes referred to herein as an interlayer or membrane. In this way, layer 14 is able to absorb underlying crack movement and forces by stretching and contracting as necessary. Accordingly, a top pavement layer is not influenced by cracks and the like in the underlying pavement. A layer 16 of bituminous emulsion is then applied to bituminous sealant layer 14 along with a subsequent layer 18 of aggregate particles. It will be understood that aggregate particle layer 18 is preferably compacted into bituminous emulsion layer 16 so as to assist the binding together of such layers. A layer of new pavement 20 (see FIG. 2) may optionally be applied directly on top of surface treatment 5 or indirectly with a leveling course 22 therebetween.

While previous methods of repairing or treating pavement involve similar actions, they have not involved providing a continuous pretreatment layer nor performing the steps in an automatic, controlled fashion. Moreover, it has been found that applying layers 14 and 16 of bituminous sealant and bituminous emulsion, respectively, at a predetermined temperature and application rate creates a thermal reaction between such layers 14 and 16 which accelerates the material break and cure time therefor. The time necessary for such action to occur is less than approximately 30 minutes, preferably within a range of approximately 1–10 minutes, and optimally within a range of approximately 1–5 minutes. This clearly is a desirable feature since traffic is permitted to travel on the present surface treatment more quickly. In particular, it has been found that the bituminous sealant of layer 14 should preferably be maintained within a temperature range of approximately 250–425° F. and the bituminous emulsion of layer 16 should preferably be maintained within a temperature range of approximately 77–210° F. A more preferred temperature range for the bituminous sealant and bituminous emulsion is approximately 300–400° F. and approximately 100–200° F., respectively, while optimal ranges are preferably approximately 325–375° F. and approximately 150–190° F. Another benefit of the present surface treatment is that the amount of water contained within the bituminous emulsion can be reduced, which further serves to reduce the time required for curing. The aggregate particles of layer 18 will typically be at approximately ambient temperature, but preferably will be maintained at a temperature of less than approximately 300° F. Thus, the use of dry, heated aggregate is not required with surface treatment 5.

With respect to the predetermined application rate for the respective materials, it has been found that the bituminous sealant and bituminous emulsion are preferably applied within a range of approximately 0.05–1.0 gallon per square yard, with a more preferred application rate for the bituminous sealant and bituminous emulsion being approximately 0.075–0.75 gallon per square yard and an optimal application rate being approximately 0.1–0.5 gallon per square yard. The aggregate particles are preferably applied at a rate of approximately 7–60 pounds per square yard during the thermal reaction between bituminous sealant layer 14 and bituminous emulsion layer 16. It will be appreciated that application of the aggregate particles during the thermal reaction of the bituminous sealant and bituminous emulsion aids in embedding the aggregate particles and enhances adhesion of the aggregate particles to bituminous emulsion layer 16. The desirable step of compacting layers 14, 16 and 18 also preferably occurs before the thermal reaction between the bituminous sealant and the bituminous emulsion has been completed. It will be understood that layer 16 of bituminous emulsion is applied in a substantially uniform amount on layer 14 of bituminous sealant and layer 18 of aggregate particles is likewise provided in a substantially uniform amount on layer 16 of bituminous emulsion. It will be understood that the actual rate of application for bituminous sealant layer 14 is dependent upon the pavement voids which need to be filled, whereas the application rate for bituminous emulsion layer 16 and aggregate layer 18 is primarily dependent upon the size of the aggregate particles utilized.

Since layers 14, 16 and 18 of bituminous sealant, bituminous emulsion, and aggregate particles, respectively, are able to be applied successively along a particular direction of advance (signified by arrow 24 in FIGS. 1 and 2) within a period of approximately 10 seconds or less, this enables such layers to be performed in a single pass by an apparatus 50 specially designed for the task described in greater detail hereinafter. Naturally, the ability to provide surface treatment 5 in a single pass greatly reduces the amount of construction time and expense involved with treating pavement 10. In this regard, application of layers 14, 16 and 18 is preferably performed along the direction of advance 24 within a range of 30–400 feet per minute and preferably at a rate of at least approximately 60 feet per minute. Although FIG. 1 depicts each layer 14, 16 and 18 as being applied separately, it will be appreciated that layers 16 and 18, for example, may alternatively be applied substantially simultaneously or even together as a mixture.

It will be appreciated that the bituminous sealant utilized for layer 14 is a composition which exhibits a distinct improvement in low temperature properties, improved adhesion to underlying pavement structures, reflective cracking reduction capabilities, and added moisture resistance to the underlying pavement structure to which it is applied. Further, the present bituminous sealant is formulated to provide sufficient softening points that render the sealant membrane 14 resistant to normal pavement operation temperatures so such sealant layer 14 does not bleed through the overlay of aggregate or additional asphalt pavement structures. The bituminous sealant of the present invention is also sufficiently fluid at the application temperature so it is capable of being applied using the spreader box 66 described herein and it is able to flow into existing cracks and pavement imperfections, forming a sealant and adhesive binder to strengthen pavement 10. The viscosity of the bituminous sealant is sufficiently fluid that the turbulent flow created by applicators 76 lifts and mixes any remaining surface contaminants within the bituminous sealant to provide improved adhesion to the pavement surface as described herein.

In view of the characteristics desired, the bituminous sealant preferably contains a mixture of asphalt cement and a low temperature, crack inhibiting or stabilizing amount of a polymer modifier. In addition, other modification additives may be included, such as fibers, adhesion promoters, anti-stripping additives, cross-linking or vulcanization agents, gellants, fillers, extenders, fluxing agents, plasticisers, or others commonly known to those skilled in the art. More specifically, the bituminous sealant composition will preferably include the following: (a) approximately 80–98% by weight of asphalt cement; (b) approximately 0–20% by weight of a polymer modifier; (c) approximately 0–10% by weight of a reinforcement additive; and, (d) approximately 0–5% by weight of an adhesion promoter or anti-stripping agent. A more preferred range and an optimal range for each of the aforementioned ingredients of the bituminous sealant composition are: (a) approximately 85–95% (more preferred) and approximately 88–96% (optimal) by weight of asphalt cement; (b) approximately 0–15% (more preferred) and approximately 0–10% (optimal) by weight of a polymer modifier; (c) approximately 0–7% (more preferred) and approximately 0–5% (optimal) by weight of a reinforcement additive; and, (d) approximately 0–4% (more preferred) and approximately 0–3% (optimal) by weight of an adhesion promoter or anti-stripping agent.

It will be understood that asphalt cements suitable for use in the present bituminous sealant composition may be any of those obtained from the conventional refining of petroleum crude oils, synthetic crudes, recovered tars from tar sands, residues from the refining of shale oils, or naturally occurring asphalts such as Trinidad Lake asphalt. Preferred asphalts will have penetrations in the range of approximately 5–400 dmm as measured according to ASTM method D-5, a viscosity of approximately 100–4000 Poise according to ASTM method D-2171, and a softening point of approximately 50–190° F. when measured using the ring and ball method of ASTM D-36.

The polymer modifiers preferred for use with the present invention are selected from a group of elastomers including, but not limited to, SB, SBS, or SBR rubbers, including both linear and radial variations and having molecular weights of about 20,000 to about 400,000. Other polymer modifiers which may be used are not narrowly critical and may be selected from a group including polyethylenes, ethylene copolymers, ethylene terpolymers, epoxies, phenolics, acrylates, methacrylates, urethanes, siloxanes, polybutenes, and crumb rubbers.

The reinforcement additives are not narrowly critical and preferably are selected from a group including fibers, mica, talcs, crumb rubber, fly ash, and sepiolite clays.

Adhesion promoters used in the present bituminous sealant are selected from a group including amine compositions, anti-strips, surface active or wetting agents, glycol ethers, sulfonates, phosphate compositions, or combinations thereof according to the surface condition being treated.

With respect to the bituminous emulsion utilized for layer 16, it will be appreciated that the composite will exhibit sufficient viscosity so that it may be spray applied to bituminous sealant layer 14 and is capable of flowing to form layer 16. The bituminous emulsion shall also be sufficiently stable to allow for aggregate application and adhesion property development between the bituminous emulsion, bituminous sealant membrane and aggregate surfaces, yet break rapidly enough so as to allow for quick release of the treated roadway surface to traffic. The residue of the bituminous emulsion shall preferably have sufficiently high softening points so that the material does not soften under normal pavement operating temperatures and bleed. The emulsion residue will also preferably have sufficient elasticity to promote improved chip retention and provide a flexible layer that will withstand underlying pavement movements so that reflective cracking of the overlay pavement is thereby reduced or eliminated. Bituminous emulsion layer 16 is also able to provide moisture resistance to the treated surface so that penetration of moisture from the pavement surface through the underlying layers is reduced or eliminated.

Accordingly, the bituminous emulsion utilized in the present surface treatment is preferably a composition including asphalt cement, polymer modifiers, reinforcement additives, adhesion promoters, anti-strip additives, cross-linking or vulcanization additives, surfactants or emulsifying agents, and sufficient water to form an emulsion. Typically, such bituminous emulsion will include: (a) approximately 5–85% by weight of asphalt cement; (b) approximately 0.1–10% by weight of a surfactant; (c) approximately 0–10% by weight of a polymer modifier; (d) approximately 0–5% by weight of a reinforcement additive; (e) approximately 0–3% by weight of a cross-linking or vulcanization agent; (f) approximately 0–5% by weight of an adhesion promoter or anti-stripping agent; and, (g) approximately 20–75% by weight of water (sufficient to form a stable emulsion). It will be appreciated that more preferred and optimal ranges for the bituminous emulsion are: (a) approximately 25–80% (more preferred) and 60–90% (optimal) by weight of asphalt cement; (b) approximately 0.15–8% (more preferred) and approximately 0.2–3.5% (optimal) by weight of a surfactant; (c) approximately 0–8% (more preferred) and approximately 0–7% (optimal) by weight of a polymer modifier; (d) approximately 0–3% (more preferred) and 0–2.5% (optimal) by weight of a reinforcement additive; (e)

approximately 0–2.5% (more preferred) and approximately 0–2% (optimal) by weight of a cross-linking or vulcanization agent; (f) approximately 0–4% (more preferred) and approximately 0–3.5% (optimal) by weight of an adhesion promoter or anti-stripping additive; and, (g) approximately 25–50% (more preferred) and approximately 30–40% (optimal) by weight of water.

The bituminous emulsion will preferably utilize the asphalt cement, polymer modifiers, reinforcement additives, and adhesion promoters as described hereinabove with respect to the bituminous sealant. Additionally, it will be understood that the surfactants to be utilized in the emulsion composition include anionic, cationic or non-ionic emulsifier additives. The cross-linking or vulcanization agents employed in the bituminous emulsion are preferably selected from a group including sulfur, sulfur donors, accelerators, pentasulfides, phenolic compounds, or epoxies, any of which may be added in combination or in the form of a slurry or dispersion for ease of incorporation.

Other modifiers which may be added to either the bituminous sealant or emulsion for tailoring specific properties include fluxing agents, oils, plasticisers, gellants, antioxidants, hydrocarbon solvents, glycol ethers, and various other commonly known to those skilled in the art.

The aggregate particles or chips are considered to be an open graded or granular product having various sized particles ranging from a maximum particle of 1/16–1 inch.

Figure 3:
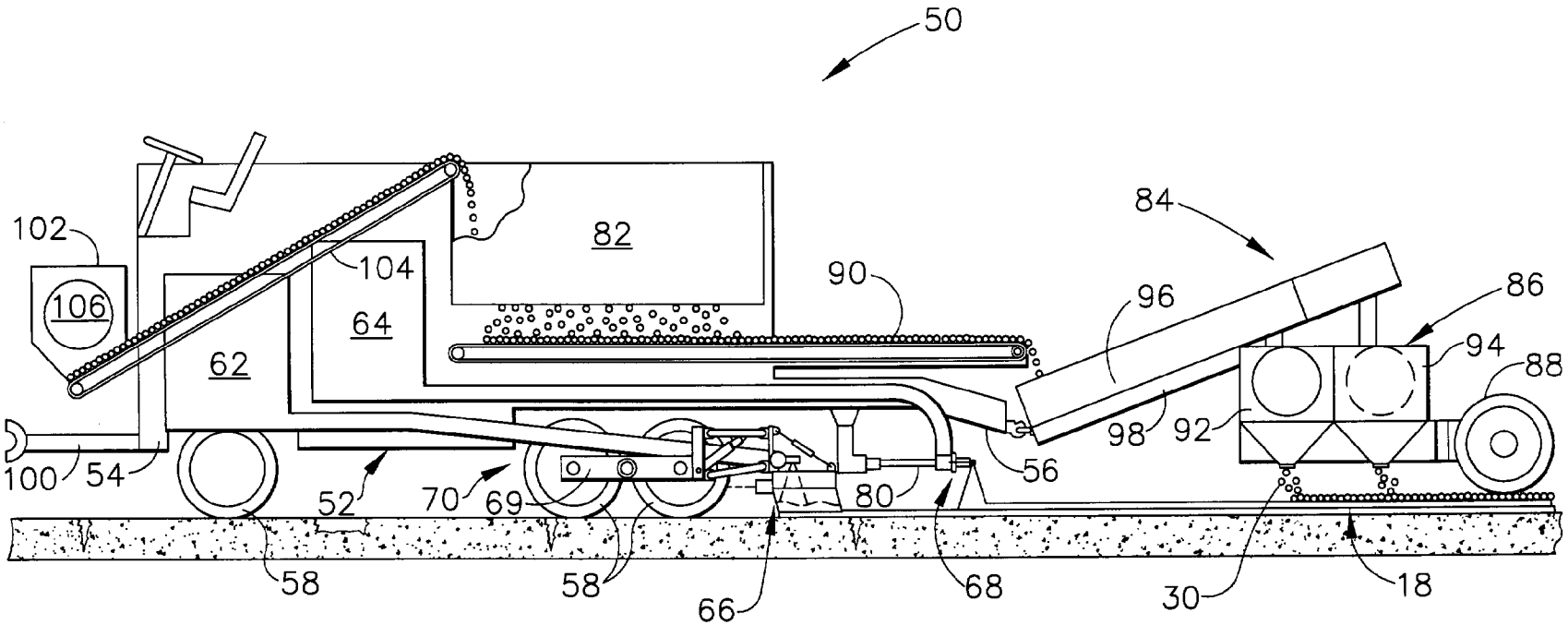
FIG. 3 is a side view of an apparatus for performing the surface treatment method of the present invention.
Figure 4:
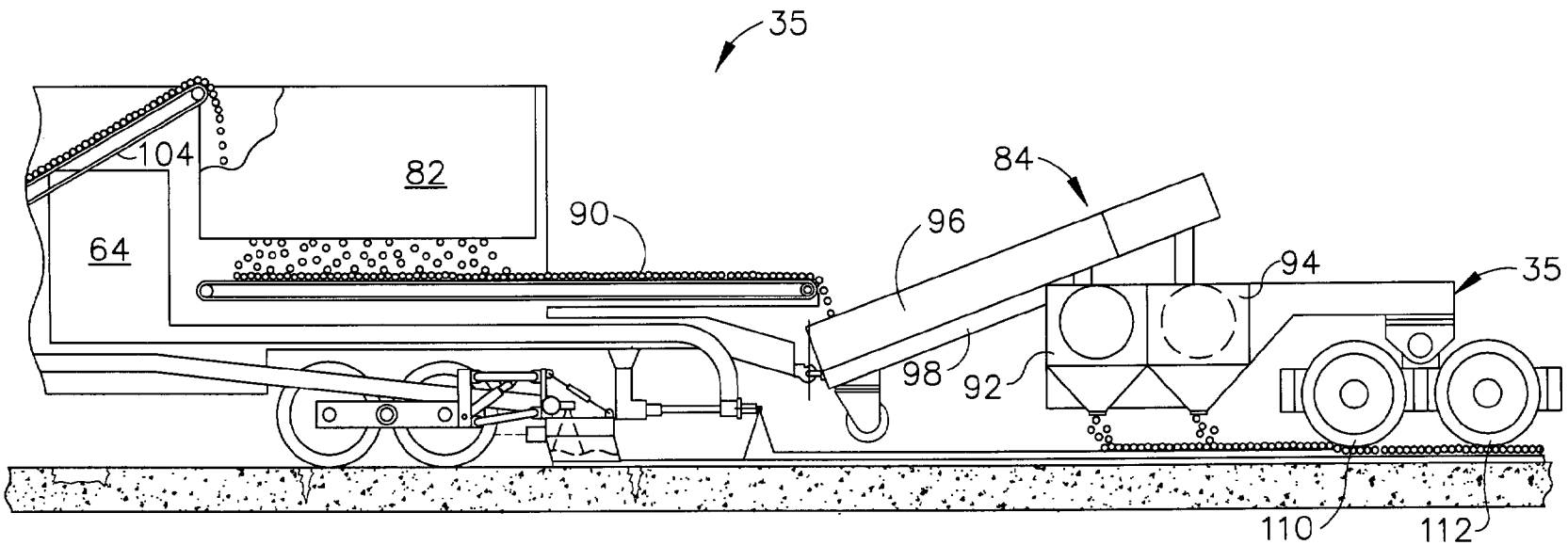
FIG. 4 is a side view of an alternative apparatus for performing the surface treatment method of the present invention.

In order to apply layers 14, 16 and 18 of the novel surface treatment method described above in a single pass, an integral continuous feed mobile device identified generally by numeral 50 is provided as depicted in FIGS. 3 and 4. As seen in FIG. 3, device 50 is a vehicle having a chassis 52 with a forward end 54 and a rear end 56. A plurality of rolling means 58 are spaced longitudinally along chassis 52, which functions to support chassis 52 so it can roll along direction of advance 24. An engine or other powerplant 60 is indicated simplistically as a means for moving chassis 52.

It will further be seen that device 50 includes a first storage tank 62 and a second storage tank 64 mounted on chassis 52 for containing bituminous sealant and bituminous emulsion, respectively. A first mechanism 66 is in flow communication with first storage tank 62 for applying layer 14 of bituminous sealant at the predetermined temperature and application rate on the surface of pavement 10. A second mechanism 68 is in flow communication with second storage tank 64 for applying layer 16 on bituminous sealant layer 14, wherein the thermal reaction described hereinabove occurs to accelerate the material break and cure time therefor. It will be appreciated that first and second storage tanks 62 and 64 each include a controlled heating system in association therewith for maintaining the bituminous sealant and the bituminous emulsion at the predetermined temperatures previously described for each.

Figure 5:
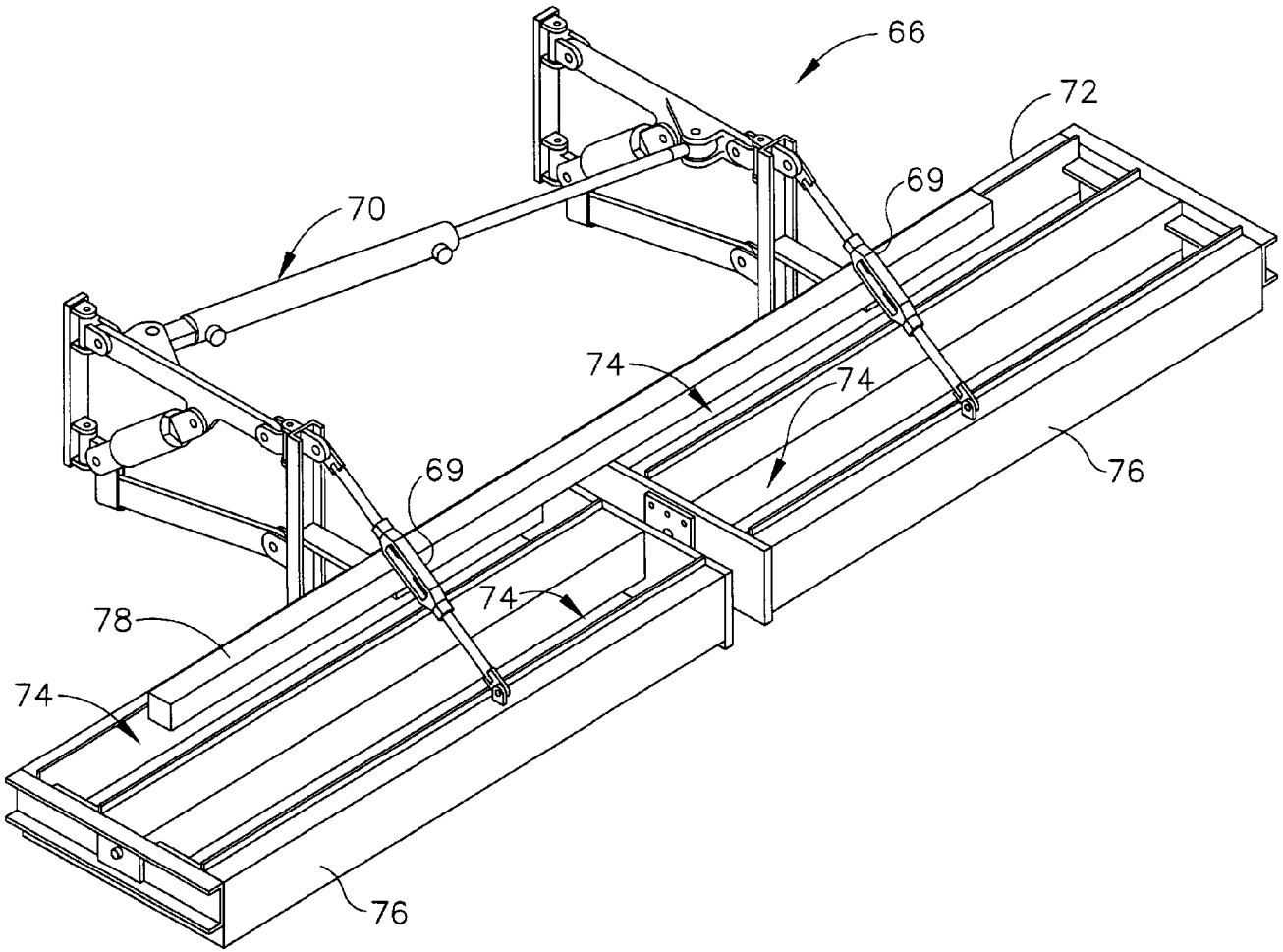
FIG. 5 is a perspective view of the spreader box depicted in FIGS. 3 and 4 for applying the layer of bituminous sealant.
Figure 6:
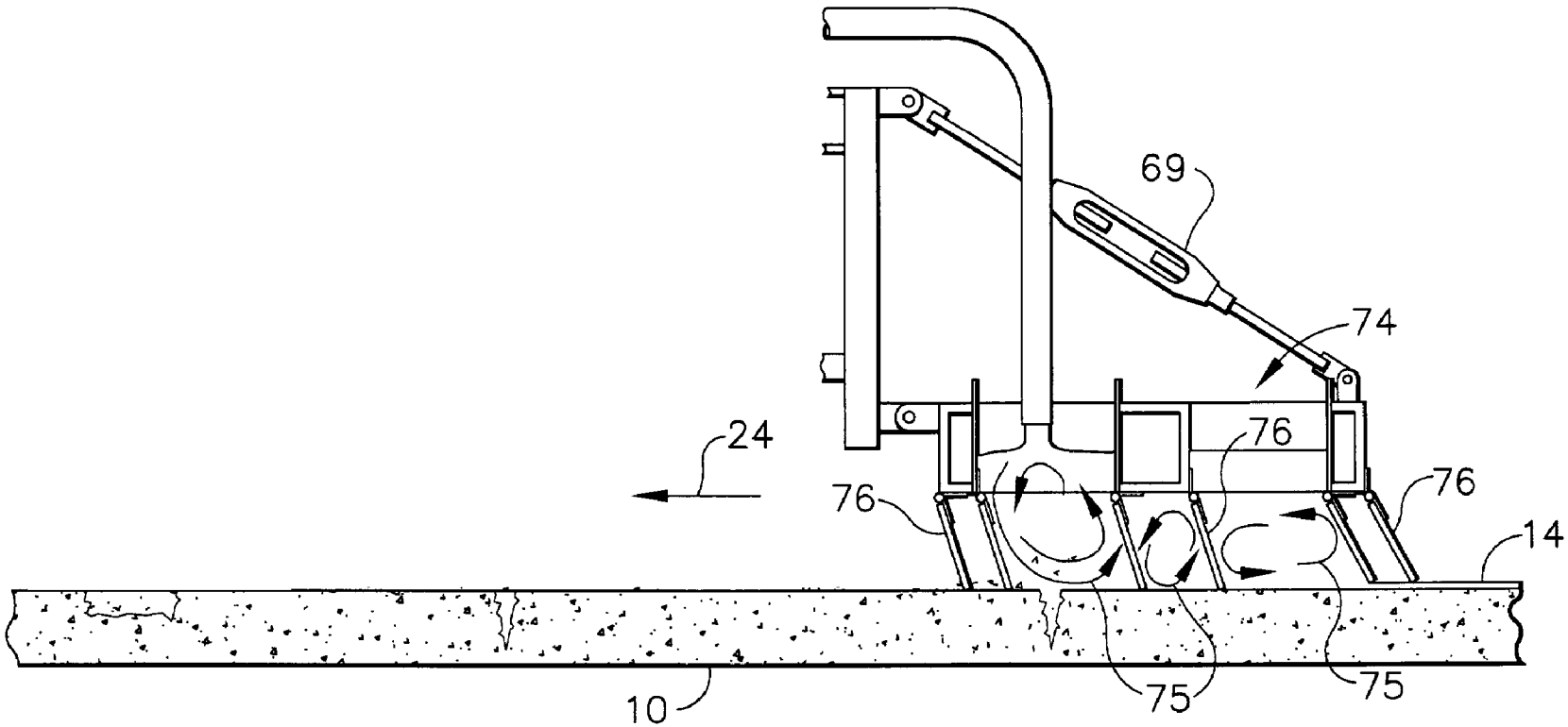
FIG. 6 is a partial side view of the spreader box depicted in FIG. 5, where the turbulent flow of bituminous sealant is shown.
Figure 7:
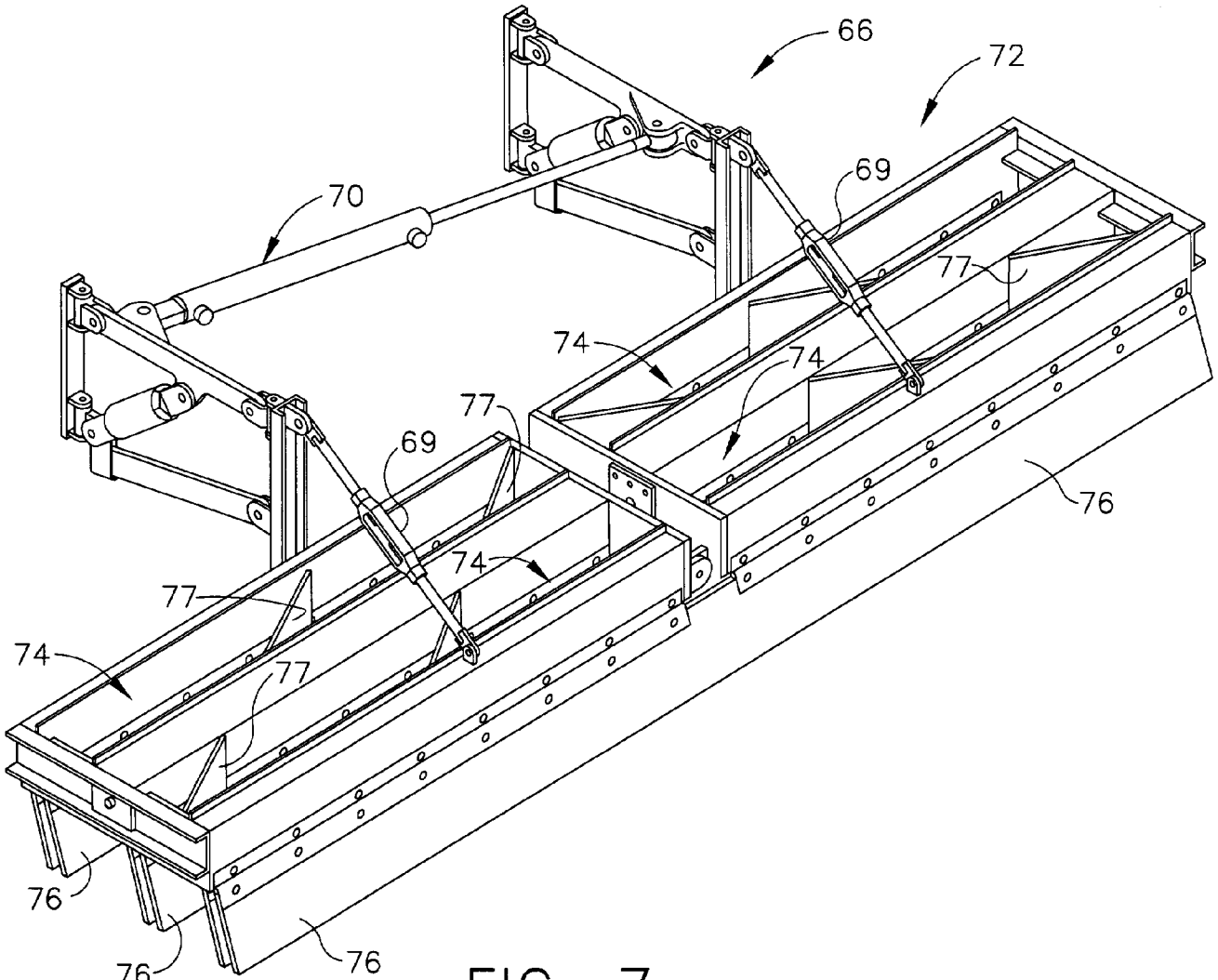
FIG. 7 is a perspective view of an alternative design for the spreader box depicted in FIGS. 3 and 4 for applying the layer of bituminous sealant; and, FIG. 8 is a partial side view of the apparatus depicted in FIGS. 3 and 4 including an alternative configuration for spreading aggregate particles.

More specifically, first mechanism 66 is preferably a spreader box connected to chassis 52 by means of walking beams 69 in a tandem suspension 70. It will be seen from FIG. 5 that spreader box 66 includes a frame 72 which preferably defines one or more cavities 74 therein for receiving the bituminous sealant. Spreader box 66 further includes one or more applicators 76 extending from frame 72 which serve to wipe and level the bituminous sealant applied so as to provide a substantially uniform layer 14 on pavement 10. As depicted in FIG. 6, applicators 76 also serve to create a turbulent flow of bituminous sealant (identified by reference numeral 75) on the surface of pavement 10 which lifts any remaining surface contaminants and suspends them in bituminous sealant layer 14. In this way, adhesion between bituminous sealant layer 14 and pavement 10 is improved. FIG. 7 depicts spreader box 66 as alternatively including applicators 77 which are constructed and/or oriented so as to be angled with respect to the movement direction 24 and likewise provide the desirable turbulent flow of bituminous sealant during operation.

It will be understood that applicators 76 and 77 may be segmented to permit the passage of elevated road castings (such as sewer lids) to prevent excess material from being deposited on or around such castings. The thickness of layer 14 is controlled by maintaining frame 72 at a substantially constant height above the surface of pavement 10. It will further be seen the bituminous sealant is provided to spreader box 66 by a distribution bar 78, from which the material is metered to and distributed across the width of spreader box 14 in conjunction with an appropriately configured pump and valves (not shown). In order to accommodate applications of varying width, spreader box 66 is preferably constructed with laterally oriented tubes and cylinders to permit expansion of frame 72 from 10–16 feet. Similarly, distribution bar 78 is preferably configured so that it can be adjusted to distribute material across the maximum available width of spreader box 66. It will also be appreciated that such adjustments of spreader box 66 and distribution bar 78 may be made hydraulically or pneumatically while the surface treatment method of the present invention is in process.

Second mechanism 68 is preferably a spray bar assembly similar to distribution bar 78 which is mounted rearwardly of spreader box 66 on a parallelogram support assembly 80 so that it is able to shift laterally when required (i.e., when resurfacing a curved surface). The bituminous emulsion is provided to spray bar assembly 68 by means of appropriately configured pumps and valves (not shown). It will be appreciated that spray bar assembly 68 is able to apply a substantially continuous layer 16 of bituminous emulsion to layer 14 of bituminous sealant so that the aforementioned thermal reaction is initiated.

With regard to the application of aggregate particle layer 18, it will be seen that apparatus 50 includes a main hopper 82 mounted on chassis 52 for storing such aggregate particles (typically rocks/stones/gravel). A third mechanism, denoted generally by numeral 84, is in flow communication with main hopper 82 for providing layer 18 of aggregate particles at the predetermined application rate on layers 14 and 16 during the thermal reaction between the bituminous sealant and bituminous emulsion. More specifically, third mechanism 84 includes a device 86 for distributing the aggregate particles which is preferably pivotally attached to and towed behind chassis rear end 56 so that it can follow chassis 52 in the direction of advance through turns, curves and the like. Distributing device 86 is well known in the art and includes at least one rolling means 88 for supporting device 86 so it can roll along in the direction of advance 24. A first conveyor device 90 is also provided as part of third mechanism 84 for transporting aggregate particles from main hopper 82 to distributing device 86. It will be appreciated that distributing device 86 preferably is configured to have first and second components 92 and 94 to provide for width adjustments and first conveyor device 90 communicates with belt or screw conveyors 96 and 98 (which are in a diverging disposition to each other) so as to deliver aggregate to first and second distributing device components 92 and 94, respectively.

Figure 8:
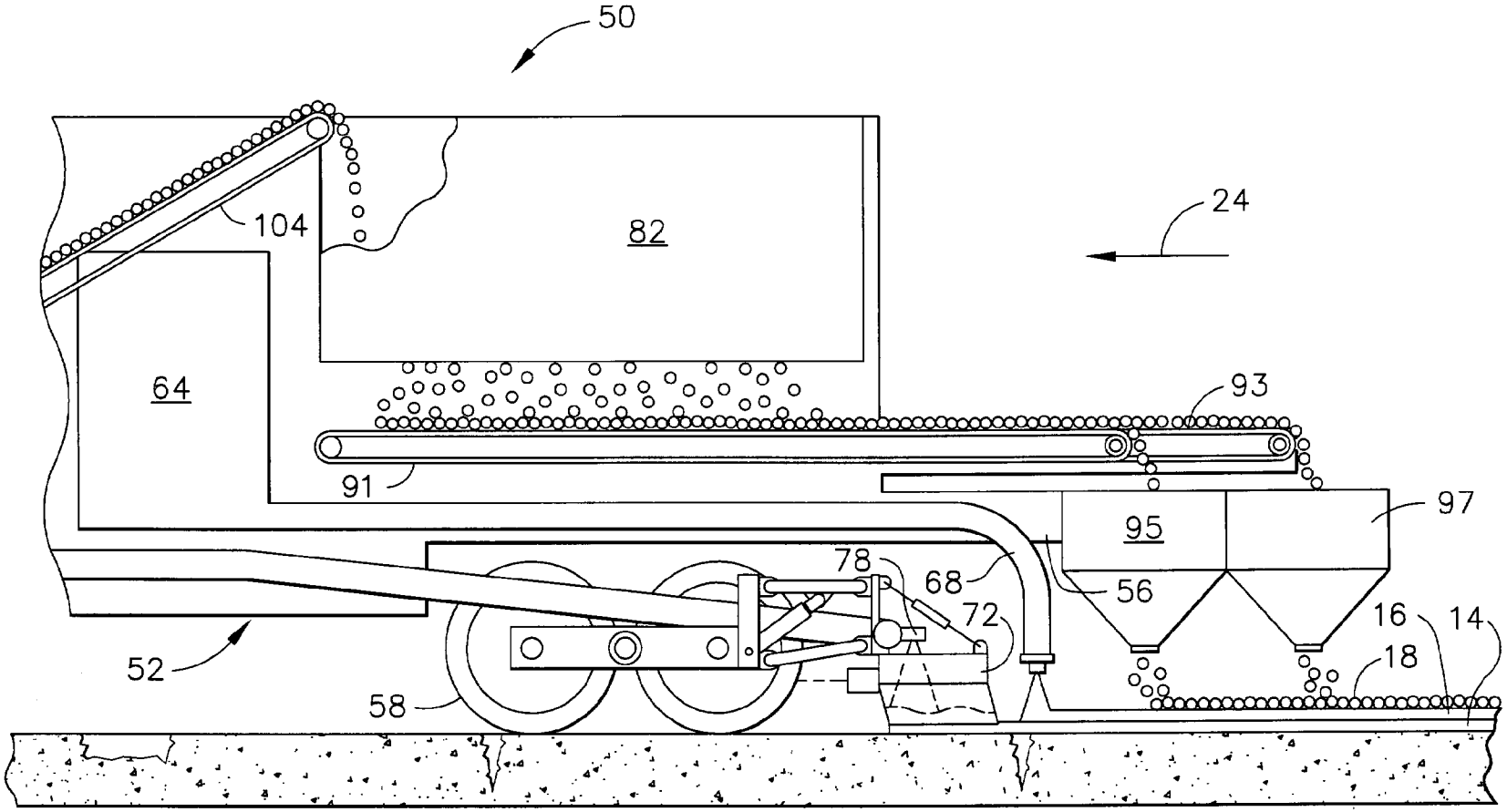

An alternative configuration for the spreading of aggregate particles without towing a separate device behind apparatus 50 is depicted in FIG. 8. As seen therein, it is preferred that a pair of conveyors 91 and 93 be in flow communication with main hopper 82 so as to receive and transport the aggregate particles therefrom. It will then be appreciated that conveyors 91 and 93 deliver the aggregate particles directly to a pair of distribution devices 95 and 97, respectively, which are attached to rear end 56 of chassis 52. Distribution devices 95 and 97 are preferably extendable in order to accommodate a desired width of pavement surface while maintaining a steady flow of aggregate particles on layers 16 and 18. While a single conveyor and distribution device is able to perform the intended function, staggering at least two distribution devices with separate conveyors of varying length permits added flexibility for pavement surfaces of greater width and a more steady flow of aggregate particles to the surface treatment. It will be appreciated that distribution devices 95 and 97 may be constructed similarly to the first and second components 92 and 94 described above and may include augers or other devices for balancing the flow of aggregate particles distributed therefrom. By attaching distribution devices 95 and 97 to rear end 56 of chassis 52, apparatus 50 is able to eliminate the need for a towed device which could produce tracks in the surface treatment and apply the aggregate particles even quicker to bituminous emulsion layer 16.

In order to permit a continuous supply of aggregate particles to main hopper 82, chassis forward end 54 preferably has a pair of grippers 100 which allow a supply vehicle to be positioned immediately forward of chassis forward end 54 and be powered by apparatus 50. A transfer hopper 102 is then provided adjacent chassis forward end 54 for receiving aggregate particles therefrom, as well as an inclined conveyor mechanism 104 for transporting such aggregate particles from transfer hopper 102 to main hopper 82. It will be recognized that transfer hopper 102 preferably includes opposed screw conveyors 106 for urging the supplied aggregate particles to the center thereof where it is dispensed on inclined conveyor mechanism 104. In this way, inclined conveyor 104 is able to deliver a continuous supply of aggregate to main hopper 82 and, correspondingly, main hopper 82 is sized so as to continue the process of the present invention while the aggregate supply truck disconnects from mobile device 50 and another full supply truck is coupled thereto. Contrary to other processes currently utilized, the present invention prevents heavy supply trucks from contacting and damaging the treated pavement surface during the surface application process.

It is preferred, as seen in FIG. 4, that mobile device 50 further include a surface roller assembly 108 which includes a forward roller assembly 110 and a rear roller assembly 112 to compact layers 14, 16 and 18. Roller assemblies 110 and 112 each include a series of smooth roller wheels which can be individually mounted to enable different rotational speeds such as for negotiating a curve. It is also appreciated that rear roller assembly 112 is optionally staggered laterally with respect to forward roller assembly 110 in order to compact the entire area of the surface treatment without sliding stresses. As with aggregate distributing device 86, surface roller assembly 108 may be towed by mobile device 50 or have auxiliary propulsion along with a central pivot to provide steering capability.

Having shown and described the preferred embodiment of the present invention, further adaptations of the method of treating a pavement surface, the surface treatment produced by such method, and the apparatus for performing such method can be accomplished by appropriate modifications by one of ordinary skill in the art without departing from the scope of the invention.

What is claimed is:

1. An apparatus for treating a pavement surface with a plurality of layers in a single pass, comprising:

(a) a chassis having a forward end and a rear end;

(b) a plurality of rolling means spaced longitudinally along said chassis for supporting said chassis so it can roll along a particular direction of advance;

(c) a powerplant for moving said chassis along said direction of advance;

(d) a first storage tank mounted on said chassis for containing bituminous sealant;

(e) a second storage tank mounted on said chassis for containing bituminous emulsion;

(f) a main hopper mounted on said chassis for storing aggregate particles;

(g) a first mechanism in flow communication with said first storage tank for applying a layer of bituminous sealant at a predetermined temperature and application rate on said pavement surface;

(h) a second mechanism in flow communication with said second storage tank for applying a layer of bituminous emulsion at a predetermined temperature and application rate on said layer of bituminous sealant, wherein a thermal reaction occurs between said bituminous sealant and said bituminous emulsion so as to accelerate a material break and cure time for said layers; and (i) a third mechanism in flow communication with said main hopper for providing a layer of aggregate particles at a predetermined application rate on said layers of bituminous sealant and bituminous emulsion during said thermal reaction.

2. The apparatus of claim 1, said first storage tank including a controlled heating system associated therewith for maintaining said bituminous sealant at said predetermined temperature therefor.

3. The apparatus of claim 1, said second storage tank including a controlled heating system associated therewith for maintaining said bituminous emulsion at said predetermined temperature therefor.

4. The apparatus of claim 1, said first mechanism further comprising:

(a) a spreader box connected to said chassis; and (b) a distribution bar for supplying bituminous sealant to said spreader box.

5. The apparatus of claim 4, said spreader box further comprising:

(a) a frame defining at least one cavity for receiving bituminous sealant from said distribution bar; and, (b) at least one applicator extending from said frame;

wherein said applicator creates a turbulent flow of bituminous sealant on said pavement surface which lifts contaminants therefrom into said bituminous sealant and improves adhesion between said pavement surface and said bituminous sealant layer.

6. The apparatus of claim 1, said second mechanism further comprising a spray bar assembly mounted rearwardly of said first mechanism.

7. The apparatus of claim 1, said third mechanism further comprising:

(a) a device for distributing said aggregate particles attached to and towed behind said chassis rear end; and (b) a conveyor device for transporting aggregate particles from said main hopper to said distributing device.

8. The apparatus of claim 7, wherein said distributing device is pivotally connected to said chassis rear end.

9. The apparatus of claim 7, said distributing device further comprising at least one rolling means for supporting said distributing device so it can roll along said direction of advance.

10. The apparatus of claim 1, said third mechanism further comprising:

(a) a device for distributing said aggregate particles attached to said chassis rear end; and (b) a conveyor device for transporting aggregate particles from said main hopper to said distributing device.

11. The apparatus of claim 10, wherein said distributing device extends rearwardly of said second mechanism.

12. The apparatus of claim 10, said conveyor device further comprising a plurality of conveyors for transporting aggregate particles from said main hopper to said distributing device.

13. The apparatus of claim 12, wherein said plurality of conveyors extend a varying length from said chassis rear end.

14. The apparatus of claim 12, wherein a separate distributing device is associated with each conveyor.

15. The apparatus of claim 1, further comprising:

(a) a transfer hopper for receiving aggregate particles at said chassis forward end; and (b) a conveyor mechanism for transporting aggregate particles from said transfer hopper to said main hopper.

16. The apparatus of claim 15, further comprising a pair of spaced members extending from said chassis forward end for receiving a vehicle supplying aggregate particles to said transfer hopper.

17. The apparatus of claim 1, further comprising a device for controlling the flow of said bituminous sealant to said first mechanism, said bituminous emulsion to said second mechanism, and said aggregate particles to said third mechanism so as to maintain said predetermined application rates thereof.

18. The apparatus of claim 1, further comprising a roller assembly connected to said third mechanism so as to compact said bituminous sealant layer, said bituminous emulsion layer, and said aggregate particles.

19. An apparatus for providing a surface treatment to pavement, comprising:

(a) a chassis having a forward end and a rear end;

(b) a plurality of rolling means spaced longitudinally along said chassis for supporting said chassis so it can roll along a particular direction of advance;

(c) a powerplant for moving said chassis along said direction of advance;

(d) a first storage tank mounted on said chassis for containing bituminous sealant;

(e) a second storage tank mounted on said chassis for containing bituminous emulsion;

(f) a main hopper mounted on said chassis for storing aggregate particles;

(g) a spreader box connected to said chassis and in flow communication with said first storage tank, wherein a layer of bituminous sealant is applied at a predetermined temperature and application rate on said pavement;

(h) a spray bar connected to said chassis rearwardly of said spreader box and in flow communication with said second storage tank, wherein a layer of bituminous emulsion is applied at a predetermined temperature and application rate on said layer of bituminous sealant; and, (i) a distribution device in flow communication with said main hopper, wherein a layer of aggregate particles is provided at a predetermined application rate on said layers of bituminous sealant and bituminous emulsion.

* * * * *